US005376329A

United States Patent [19]

Morgan et al.

[11] Patent Number: 5,376,329

[45] Date of Patent: Dec. 27, 1994

[54] METHOD OF MAKING COMPOSITE ORIFICE FOR MELTING FURNACE

[75] Inventors: Ricky D. Morgan, Milan; James A. Giffen, Jr., Towanda, both of Pa.

[73] Assignee: GTE Products Corporation, Danvers, Mass.

[21] Appl. No.: 976,734

[22] Filed: Nov. 16, 1992

[51] Int. Cl.[5] ..... B22F 3/00

[52] U.S. Cl. ..... 419/39; 419/6; 419/28; 419/38; 419/44

[58] Field of Search ..... 13/6, 8; 29/420, 517; 60/261; 72/377; 75/208, 213, 415; 228/194; 419/6, 8, 9, 10, 15, 38; 428/547; 429/112

[56] References Cited

U.S. PATENT DOCUMENTS

| | | | |
|---|---|---|---|
| 3,780,418 | 12/1973 | Hurst | 29/420 |
| 4,017,294 | 4/1977 | Sanford et al. | 65/326 |
| 4,061,841 | 12/1977 | Sharma et al. | 429/112 |
| 4,063,940 | 12/1977 | Dain et al. | 75/213 |
| 4,612,162 | 2/1988 | Morgan et al. | 419/9 |
| 4,726,927 | 2/1988 | Morgan et al. | 419/9 |

OTHER PUBLICATIONS

Goetzel, C. G., "Treatise on Powder Metallurgy" p. 4. Interscience Publishers Inc. (1949).

*Primary Examiner*—Donald P. Walsh
*Assistant Examiner*—John N. Greaves
*Attorney, Agent, or Firm*—Elizabeth A. Levy; Robert F. Clark

[57] ABSTRACT

A method of making a composite orifice having a tungsten core which is diffusion bonded to a molybdenum shell. Tungsten and molybdenum powders in contact with each other in a mold are isostatically pressed to form a pressed bonded composite part. The pressed, unsintered tungsten core portion of the part is then machined to the desired dimensions. The pressed composite part is then sintered to form a diffusion bonded composite orifice. The pressed and sintered molybdenum shell portion of the orifice may then be machined to the desired dimensions.

4 Claims, No Drawings

METHOD OF MAKING COMPOSITE ORIFICE FOR MELTING FURNACE

TECHNICAL FIELD

This invention relates to methods of making an orifice for a melting furnace. In particular, it relates to methods of making a composite orifice having a tungsten core which is diffusion bonded to a molybdenum shell.

BACKGROUND ART

A melting furnace for glasses or ceramics is typically constructed as a refractory-lined chamber having an orifice at the bottom from which molten material may be drawn from the furnace. The orifice is subjected to extreme temperatures and has abrasive material flowing through it and must therefore be made of a material which is resistant to abrasion, corrosion and wear. In addition, it is desirable to make the orifice out of a thermally and electrically conductive material, since electric power is typically supplied to the orifice to control the temperature of material flowing through it.

Orifices made of pure tungsten offer good wear resistance but are heavy and difficult to machine and therefore quite expensive to produce. Those made of pure molybdenum are lighter and easier to machine but are less wear-resistant and must be frequently replaced. Because melting furnaces operate at very high temperatures, it is most economical to operate them continuously, thereby avoiding unnecessary energy consumption associated with interruptions and cooldowns. It is very costly to shut down a furnace and empty it in order to replace a worn or disintegrated orifice. Thus, it would be advantageous to have orifices which are durable and rugged.

Composite orifices, as defined herein, are those which are made of at least two dissimilar materials, such as, for example, tungsten and molybdenum or tungsten and iridium. Composite orifices may be made using powder metallurgical techniques in combination with other fabrication processes. Typically, the core and the shell portions are fabricated separately and then press-fit together. For example, the shell portion may be made by powder metallurgical techniques and sintered around a solid metal core to form a tight fit as the shell portion shrinks during sintering. However, unless the core and shell parts are actually bonded together in some way, the core is likely to loosen during furnace operation.

It would be an advancement in the art to provide an efficient and economical method of making a durable wear- and abrasion-resistant composite orifice for a melting furnace.

SUMMARY OF THE INVENTION

It is an object of this invention to obviate the disadvantages of the prior art.

It is another object of this invention to enhance methods of making composite parts.

It is another object of this invention to enhance methods of making composite orifices for melting furnaces.

These objects are accomplished, in one aspect of the invention, by a method of making a composite part. Dissimilar powders are introduced into separate compartments of a mold having a plurality of such compartments separated by at least one removable partition therebetween. The removable partitions are then removed from the mold to allow the dissimilar powders to contact each other along an interface. The mold is then sealed and the powders inside are subjected to isostatic compaction under sufficient pressure to obtain a first composite body having sufficient strength to maintain its pressed shape upon its removal from the mold. The first composite body has a density of between 55 and 70% of the average of the theoretical densities of the dissimilar powders. The first composite body is then removed from the mold and subjected to machining operations. It is then sintered at a sufficient temperature to obtain a second composite body having a density of greater than 95% of the average of the theoretical densities of the dissimilar powders.

These objects are accomplished, in another aspect of the invention, by a method of making a composite orifice for a melting furnace. The orifice consists of a tungsten core which is bonded to a molybdenum shell. The method involves the introduction of tungsten and molybdenum powders into a mold of predetermined configuration which has a central portion and a surrounding portion, and a removable partition therebetween. The tungsten metal powder is introduced into the central portion of the mold, and the molybdenum metal powder is introduced into the surrounding portion of the mold. The removable partition separating the tungsten powder from the molybdenum powder is then removed so that the powders contact each other along an interface. The mold is then sealed and the powders inside are subjected to isostatic compaction under sufficient pressure to produce a pressed body consisting of a pressed tungsten core which is press bonded to a pressed molybdenum shell at the interface between the powders. The pressed body has sufficient strength to maintain its pressed shape upon its removal from the mold and has a density of between 55 and 70% of the average of the theoretical densities of the tungsten and molybdenum powders. The pressed body is then removed from the mold, and the pressed tungsten core is then machined to the desired dimensions. The pressed body is then sintered at a sufficient temperature to produce a sintered body consisting of a sintered tungsten core which is diffusion bonded to a sintered molybdenum shell at the interface between the pressed tungsten core and the pressed molybdenum shell. The sintered body has a density of greater than 95% of the average of the theoretical densities of the tungsten and molybdenum powders.

BEST MODE FOR CARRYING OUT THE INVENTION

The method of this invention involves a sequence of steps by which a composite orifice having a tungsten core and a molybdenum shell is made. The first step is the introduction of tungsten and molybdenum metal powders into a mold which has at least two compartments which are separated by a removable partition. After the mold has been filled with the metal powders, the removable partition is removed from the mold to allow the tungsten and molybdenum metal powders to contact each other. The mold is then sealed and subjected to isostatic compaction at a sufficient pressure to produce a pressed body. The pressed body is removed from the mold and the tungsten core portion of the pressed body is then machined to the desired dimensions. The pressed body is then sintered at a temperature sufficient to produce a sintered body. The molybdenum shell portion of the sintered body may then be machined to the desired dimensions.

During the isostatic compaction step, the tungsten core and the molybdenum shell are press bonded together. During the subsequent sintering step the tungsten core and the molybdenum shell are diffusion bonded together. The integrity of the resulting composite orifice is superior to that of orifices made by prior art methods.

During the first step of the sequence, tungsten and molybdenum metal powders are introduced into separate compartments of a mold which has at least two such compartments which are separated by a removable partition. Although other metal powders may be used, their selection must be based on a consideration of their shrinkage propensities. They must be sufficiently similar in their tendencies to shrink during pressing and sintering so that only a single pressing and sintering operation is necessary to form the composite part. The greater the difference between shrinkages of dissimilar metal powders, the wider the variation in pressed and sintered density of the final composite part, with greater chance for porosity, cracks or voids within the part. Tungsten and molybdenum are the preferred metal powders for composite orifices made by powder metallurgical techniques.

A suitable mold configuration for a composite orifice has a central portion and a surrounding portion. The central portion is preferably filled with a tungsten metal powder and the surrounding portion is preferably filled with a molybdenum metal powder. The mold may be vibrated during powder filling to induce settling of the powders into the mold compartments.

The removable partition between the mold compartments is then removed to allow the metal powders to contact each other. The mold is then sealed and the powders inside are subjected to isostatic compaction. It is desirable to apply sufficient pressure so that the powders inside the mold will be compacted to between 55 and 70% of the average of their theoretical densities. The resulting pressed composite part should be sufficiently strong to maintain its pressed shape when it is removed from the mold. If the pressure is too great, the diffusion process which normally occurs during the sintering step will be hindered because of insufficient interconnected porosity within the pressed composite part. For a composite orifice made of tungsten and molybdenum, isostatic compaction at pressures of between 35,000 and 45,000 pounds per square inch (psi) are suitable. It is preferred to compact the tungsten and molybdenum metal powders at a pressure of 45,000 psi to ensure sufficient strength in the pressed composite part.

The pressed composite part is then removed from the mold. The pressed tungsten core portion of the pressed composite part may now be machined to the desired dimensions. The tungsten core portion is machined prior to sintering because sintered tungsten is quite brittle and difficult to machine without chipping and breakage. By machining the tungsten core portion in its pressed but unsintered condition, the proper dimensions for the tungsten core portion of the finished composite orifice can be obtained with only minor touchup machining required after sintering.

After the tungsten core is machined, the pressed composite part is sintered at a temperature sufficient to obtain a sintered composite part having a density of at least 95% of the average of the theoretical densities of the tungsten and molybdenum powders. For pure tungsten a suitable sintering temperature is 2100° C., while for pure molybdenum a suitable sintering temperature is 1800° C. It is desirable to sinter the pressed composite part at lower sintering temperatures to prevent excessive grain growth in the metal which has the lowest sintering temperature. For a composite part made of tungsten and molybdenum, it is desirable to sinter the pressed composite part at a temperature of 1800° C. to prevent excessive grain growth in the molybdenum. During the sintering step the powders which were press bonded together after the isostatic compaction step become more closely bonded together at the atomic level, i.e., diffusion bonded. This diffusion bonding between the tungsten and molybdenum metal powders prevents loosening of the tungsten core during operation of the melting furnace.

After sintering is completed, the molybdenum shell portion of the sintered composite part may be machined to the desired dimensions. Molybdenum is relatively easy to machine in the sintered condition. Minor touchup machining which may be required to the tungsten core portion of the composite orifice may also be done at this time.

While there have been shown what are at present considered to be the preferred embodiments of the invention, it will be apparent to those skilled in the art that various changes and modifications can be made herein without departing from the scope of the invention as defined by the appended claims.

We claim:

1. A method of making a composite orifice for a melting furnace, said orifice consisting of a tungsten core bonded to a molybdenum shell, comprising the steps of:

a) providing a mold of predetermined configuration, said mold having a central portion and a surrounding portion and a removable partition therebetween;

b) introducing tungsten metal powder into said central portion of said mold;

c) introducing molybdenum metal powder into said surrounding portion of said mold;

d) removing said removable partition from said mold to allow said tungsten and molybdenum metal powders to contact each other along an interface;

e) sealing said mold and subjecting said metal powders therein to isostatic compaction under sufficient pressure to obtain a pressed body consisting of a pressed tungsten core press bonded at said interface to a pressed molybdenum shell, said pressed body having a sufficient strength to maintain its pressed shape upon its removal from said mold and having a density of between 55 and 70% of the average of the theoretical densities of said tungsten powder and said molybdenum powder;

f) removing said pressed body from said mold and machining said pressed tungsten core to the desired dimensions; and g) sintering said pressed body at a sufficient temperature to obtain a sintered body consisting of a sintered tungsten core diffusion bonded at said interface to a sintered molybdenum shell, said sintered body having a density of greater than 95% of the average of the theoretical densities of said tungsten powder and said molybdenum powder.

2. A method according to claim 1 wherein said tungsten and molybdenum metal powders are subjected to isostatic compaction at a pressure of 45,000 pounds per square inch.

3. A method according to claim 1 wherein said pressed body is sintered at 1800° C.

4. A method according to claim 1 wherein said sintered molybdenum shell is machined to the desired dimensions.

* * * * *